US011470927B2

(12) United States Patent
Grocq Parruitte et al.

(10) Patent No.: US 11,470,927 B2
(45) Date of Patent: Oct. 18, 2022

(54) WEARABLE FINGER RING

(71) Applicant: NOUVEL HERITAGE, SAS, Paris (FR)

(72) Inventors: Marie Christine Grocq Parruitte, Paris (FR); Camille Parruitte, Paris (FR)

(73) Assignee: Nouvel Heritage, Inc., New York, NY (US)

( * ) Notice: Subject to any disclaimer, the term of this patent is extended or adjusted under 35 U.S.C. 154(b) by 0 days.

(21) Appl. No.: 17/332,483

(22) Filed: May 27, 2021

(65) Prior Publication Data

US 2021/0378371 A1 Dec. 9, 2021

Related U.S. Application Data

(60) Provisional application No. 63/031,542, filed on May 28, 2020.

(51) Int. Cl.
*A44C 9/02* (2006.01)

(52) U.S. Cl.
CPC ..... *A44C 9/02* (2013.01)

(58) Field of Classification Search
CPC ..... A44C 9/02; A44C 5/00
USPC ..... 63/15.5, 15.6, 15.65, 15.7
See application file for complete search history.

(56) References Cited

U.S. PATENT DOCUMENTS 392,357 A 11/1888 Newman
D87,916 S 10/1932 Granat
3,678,705 A 7/1972 Korwin
3,890,801 A 6/1975 Newman
D247,482 S 3/1978 Schupp
D394,411 S 5/1998 Gozlan
5,943,882 A * 8/1999 Erb ..... A44C 9/02 63/15.5
D415,976 S 11/1999 Be
(Continued)

FOREIGN PATENT DOCUMENTS

FR 2545704 A1 11/1984
FR 2654593 A1 5/1991
(Continued)

OTHER PUBLICATIONS

International Search Report and Written Opinion dated Sep. 8, 2201 in related application No. PCT/US21/34456; 12 pgs.
(Continued)

*Primary Examiner* — Jack W Lavinder
(74) *Attorney, Agent, or Firm* — Fox Rothschild LLP

(57) ABSTRACT

Innovative jewelry articles are contemplated. The jewelry articles include a band and a link that is movable with respect to the band based on hand or finger movement. The band includes two disconnecting ends with a through hole provided at each end. The link includes two prongs with each inserted through the corresponding hole to connect the two ends. The link also includes two jewelry settings with each connected to the respective prong inserted through the hole. The settings on the band keeps the link hanging on the band. The link further includes a body that extends toward the center of the band. The body contacts the finger when the jewelry article is worn. With this contact, finger or hand movement can cause the tubular link to move up and down with respect to the band.

14 Claims, 6 Drawing Sheets

(56) References Cited

U.S. PATENT DOCUMENTS

| | | | | |
|---|---|---|---|---|
| 6,116,053 | A | 9/2000 | Siebenberg | |
| D439,192 | S | 3/2001 | Ruscitti | |
| D528,456 | S | 9/2006 | Thompson et al. | |
| D533,802 | S | 12/2006 | Thompson et al. | |
| 7,178,365 | B2 * | 2/2007 | Pitaniello | A44C 5/00 63/15 |
| D565,450 | S | 4/2008 | Lebail | |
| D626,446 | S | 11/2010 | Katzir et al. | |
| 8,225,626 | B1 | 7/2012 | Blau | |
| 8,701,438 | B1 | 4/2014 | Kovel | |
| D704,088 | S | 5/2014 | Farris | |
| D707,582 | S | 6/2014 | DiPietro | |
| D712,299 | S | 9/2014 | DiPietro | |
| 8,904,821 | B1 | 12/2014 | DiPietro | |
| 9,010,146 | B1 * | 4/2015 | Wiegert | A44C 9/0023 63/15.7 |
| D764,674 | S | 8/2016 | Quinn | |
| D780,028 | S | 2/2017 | Yatsugi-Kang | |
| D784,844 | S | 4/2017 | Amfitheatrof et al. | |
| D784,845 | S | 4/2017 | Amfitheatrof et al. | |
| D806,600 | S | 1/2018 | Amlitheatrof et al. | |
| D850,970 | S | 6/2019 | Buccellati | |
| D860,530 | S | 9/2019 | Atkinson et al. | |
| D871,954 | S | 1/2020 | Foster | |
| D897,881 | S | 10/2020 | Ashton et al. | |
| 11,103,034 | B2 * | 8/2021 | Surana | A44C 9/02 |
| 2002/0178749 | A1 * | 12/2002 | Katano | A44C 9/02 63/15.7 |
| 2004/0255620 | A1 | 12/2004 | Chuang | |
| 2006/0053835 | A1 * | 3/2006 | Roberts/Shea | A44C 17/0208 63/15 |
| 2011/0179825 | A1 | 7/2011 | Katzir et al. | |

FOREIGN PATENT DOCUMENTS

| | | | |
|---|---|---|---|
| JP | 3015507 | U | 9/1995 |
| KR | 200444190 | Y | 4/2009 |
| KR | 200491640 | Y1 | 5/2020 |
| KR | 301152586.0000 | | 2/2022 |
| WO | 2019053691 | A1 | 3/2019 |

OTHER PUBLICATIONS

James Kaya, Future, 2005,Platinum, Diamonds Tension Sets p. 81 of 500 Wedding Rings—Dec. 11, 2019 (Photos by Robert Diamante).

Design U.S. Appl. No. 29/699,499, filed Jul. 25, 2019.

Nouvel Heritage, Lookbook—Mood-Bangles Collection, Spring-Summer 2017, 21 pages www.NouvelHeritage.com.

* cited by examiner

WEARABLE FINGER RING

CROSS-REFERENCE TO RELATED APPLICATION

This application claims the benefit to U.S. provisional application No. 63/031,542, filed May 28, 2020, the entire content of which is expressly incorporated herein by reference thereto.

FIELD OF THE INVENTION

The present invention relates to jewelry. More particularly, the present invention relates to rings comprising a band and a link with jewelry settings thereon, and the link is movable with respect to the band based on hand or finger movements.

BACKGROUND OF THE INVENTION

Conventional jewelry articles such as rings generally have an endless solid band made of a previous metal. Such a design makes rings expensive as the band always requires sufficient previous metal to construct a complete loop. Such a design also may not be comfortable to everyone as the band's interior surface completely contacts the finger and reduce air transmissibility to skin. The ring is more difficult to remove and water and other moisture trapped in between takes a longer time to dry. These rings are further limited to the chosen size and there is no room for adjustment. For example, a size that fits perfectly might be too tight when the finger moves. Selecting a size larger provides room for movement but might be too lose when the finger is not moving. Ordering a ring with a bespoke band will require additional cost and time.

Moreover, one way to manufacture a band is by bending a narrow strip of precious metal gradually until the strip acquires a shape of a spiral with a plurality of loops. Each of these loops is then separated from the spiral, and its edges are seamed together. This process, however, produces rings that have a very unattractive seam in the hand (where the two edges adhered) which is visible on both the inside and outside of the ring.

Furthermore, rings that have an endless solid band is prone to damage, especially at the area where the jewelry setting and the decorative element (e.g., diamond or gem) are attached and at the area where the jewelry setting and the band are connected. When the ring is dropped on the ground or the wearer falls with the hand landing on the ground first, the ring is likely to disintegrate at one of the aforementioned areas because the endless solid band has no space to release the impact force other than through the indicated areas. This is highly undesirable as the decorative element is the most expensive component of the ring.

Additionally, most rings have the decorative element fixed to one location and is immobile with respect to the band. Such a configuration limits the number of reflection angles and viewing angles and is too common which makes the design dull. There is no rings with settings that are movable based on hand or finger movement, or with a simple structure for facilitating such movement, and with unique structures that make their appearance more appealing.

Therefore, there remains a need for jewelry articles that are improved over the prior art.

SUMMARY OF THE INVENTION

In accordance with principles of the invention, an article of jewelry is contemplated. The article of jewelry comprises a band including a first end and a second end, an opening between the first end and the second end, and a top surface and a bottom surface. The first end comprising a first hole and the second end comprising a second hole. The article of jewelry also comprises a tubular link including a body and a first jewelry setting and a second jewelry setting. The body comprises a first prong and a second prong inserted through the first hole and the second hole, respectively. The first jewelry setting is connected to the first prong inserted through the first hole and the second jewelry setting is connected to the second prong inserted through the second hole and the first jewelry setting and the second jewelry setting are on the top surface. The body further comprises a portion between the first prong and the second prong extending toward center of the band and the tubular link is movable with respect to the band.

In one embodiment, the opening is between the first jewelry setting and the second jewelry setting.

In one embodiment, the tubular link hangs on the band via the first jewelry setting and the second jewelry and is loose with respect to the band.

In one embodiment, the opening between the first end and the second end is devoid of a decorative element.

In one embodiment, the first hole and the second hole are the only holes on the band. The first hole, in its entirety, blocks the first jewelry setting from escaping the first hole to a location below the bottom surface of the band. The second hole, in its entirety, blocks the second jewelry setting from escaping the second hole to a location below the bottom surface of the band.

In one embodiment, the size of the first jewelry setting and the second jewelry setting is larger than size of the first hole and the second hole.

In one embodiment, the portion between the first prong and the second prong extending toward the center of the band with sufficient length to be contacted by a finger when the article of jewelry is worn on the finger. The tubular link is movable with respect to the band based on the finger's movement or hand movement.

In one embodiment, the tubular link is movable between a position where the first jewelry setting and the second jewelry contact the band and a position where the first jewelry setting and the second jewelry are raised above the band.

In one embodiment, the band further includes a pin and a pin receptacle adapted to receive the pin.

In one embodiment, the pin and pin receptacle are adapted to open and close the band.

In accordance with principles of the invention, another article of jewelry is contemplated. The article of jewelry comprises a band including a first end and a second end, an opening between the first end and the second end, and a top surface and a bottom surface. The first end comprising a first hole and the second end comprising a second hole. The article of jewelry also comprises a tubular link including an arcuate body and a first jewelry setting and a second jewelry setting. The arcuate body comprises a first prong and a second prong inserted through the first hole and the second hole, respectively. The first jewelry setting is connected to the first prong inserted through the first hole and the second jewelry setting is connected to the second prong inserted through the second hole, and the first jewelry setting and the second jewelry setting are on the top surface. The arcuate body curves toward center of the band and has a sufficient length into the band to contact a finger when the article of jewelry is worn on the finger, and the tubular link is movable with respect to the band based on the finger's movement or hand movement. The opening between the first end and the second end is devoid of a decorative element.

In accordance with principles of the invention, yet another article of jewelry is contemplated. The article of jewelry comprises a band including a first end and a second end, an opening between the first end and the second end, and a top surface and a bottom surface. The first end comprising a first hole and the second end comprising a second hole. The article of jewelry also comprises a tubular link including a body and a first jewelry setting and a second jewelry setting. The body comprises a first prong and a second prong inserted through the first hole and the second hole, respectively. The first jewelry setting is connected to the first prong inserted through the first hole and the second jewelry setting is connected to the second prong inserted through the second hole, and the first jewelry setting and the second jewelry setting are on the top surface. The band further includes a pin and a pin receptacle adapted to receive the pin, and the pin and a pin receptacle are adapted to open and close the band. The opening between the first end and the second end is devoid of a decorative element.

BRIEF DESCRIPTION OF THE DRAWINGS

The nature and various advantages of the present invention will become more apparent upon consideration of the following detailed description, taken in conjunction with the accompanying drawings, in which like reference characters refer to like parts throughout, and in which.

Figure 1:
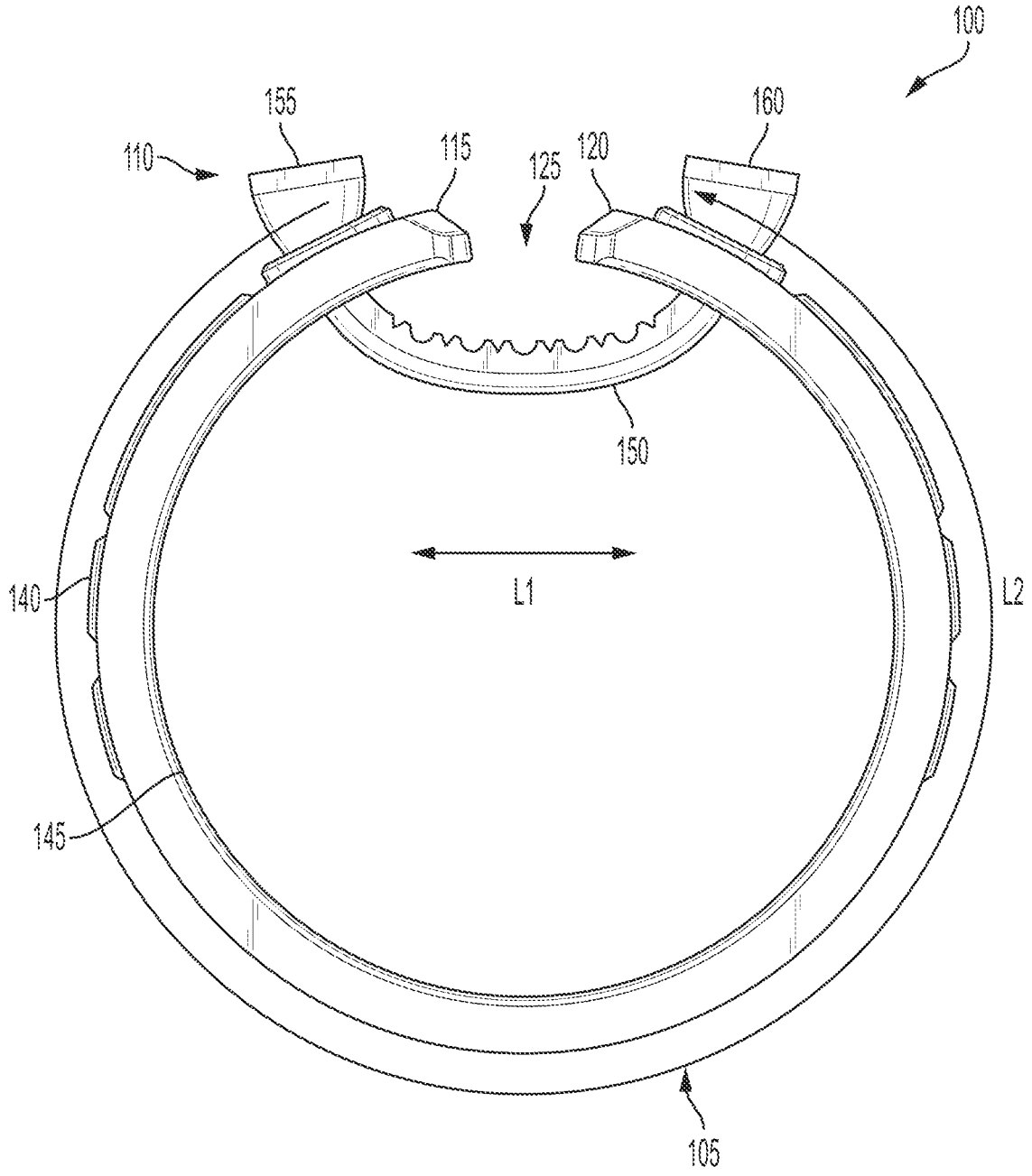
FIG. 1 depicts a front view of an illustrative article of jewelry in accordance with some embodiments of the present invention.
Figure 2:
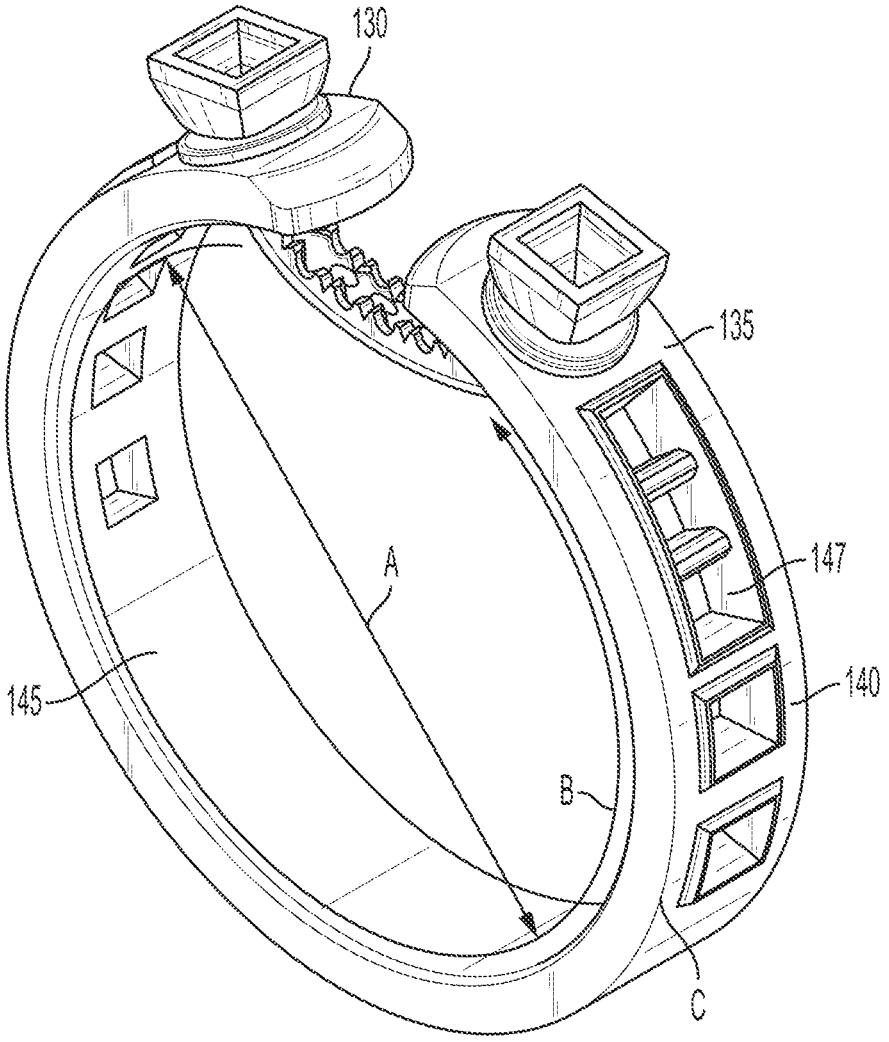
FIG. 2 depicts a perspective view of the illustrative article of jewelry of FIG. 1 in accordance with some embodiments of the present invention.
Figure 3:
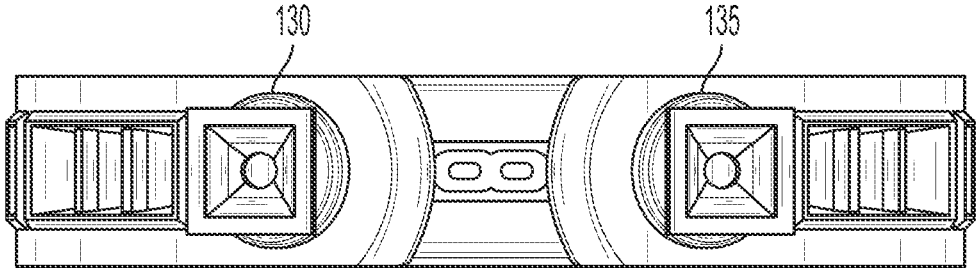
FIG. 3 depicts a top view of the illustrative article of jewelry of FIG. 1 in accordance with some embodiments of the present invention.
Figure 4:
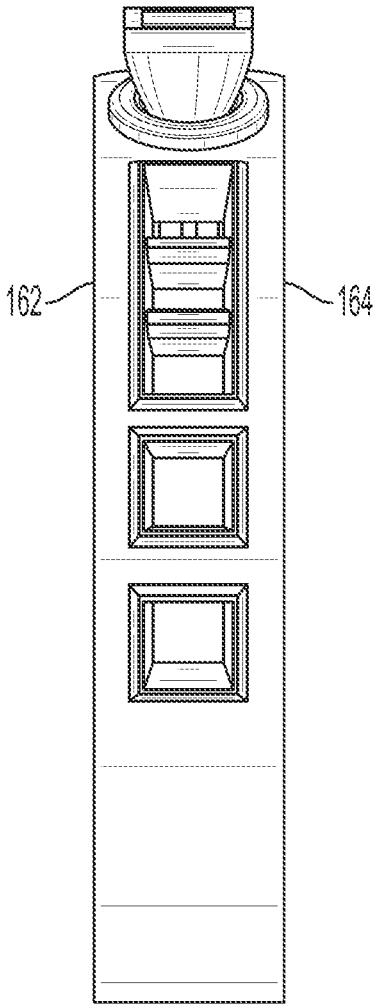
FIG. 4 depicts a side view of the illustrative article of jewelry of FIG. 1 in accordance with some embodiments of the present invention.

The components in the figures are not necessarily drawn to scale, emphasis instead being placed upon illustrating the principles of the present invention. Like parts do not always have like reference numerals. Moreover, all illustrations are intended to convey concepts, where relative sizes, shapes and other detailed attributes may be illustrated schematically rather than literally or precisely. For the sake of brevity, the instant application focuses on certain aspects of the embodiments of the present invention. It should be noted that features, components, and/or structures in the attached figures that are not described in the sections below are also part of the disclosure and are understood from the attached figures.

DETAILED DESCRIPTION OF THE INVENTION

The present application is directed to innovative jewelry articles. The jewelry articles include a band and a link that is movable with respect to the band based on hand or finger movement. The band includes two ends or two disconnecting ends with a through hole provided at each end. The link includes two prongs with each inserted through the corresponding hole to connect the two ends of the band. The link also includes two jewelry settings with each connected to the respective prong inserted through the hole. The settings on the band keeps the link hanging or floating on the band. The link further includes a body that extends toward the center of the band, or the area in which the finger is inserted. The body may be an arcuate body. The body contacts the finger when the jewelry article is worn or when the finger moves. With this contact, finger and hand movement can cause the link to move up and down with respect to the band by pushing the link upward and removing the urging force to let the link drop downward.

Such band and link structures reduce the cost to manufacture a ring. The band requires less precious metal or other expensive materials to make as an endless loop is no longer a requirement. The amount of materials saved corresponds to the size of the opening formed between the two ends of the band. The link can also be made using a different or less expensive material. The contemplated structures also are more comfortable and flexible. They reduce the amount of area that the band contacts skin because the link curves toward the finger and creates some space between the band and finger. They provide room for finger movement because the link is movable with respect to the band and based on finger movement (unlike an endless band which restricts finger movement within the band). The contemplated structures further facilitate ring removal. When the finger is at rest, the link can pulled upward to gain additional room.

Such band and link structures eliminate the seam formed by the strip bending process mentioned above. The contemplated band has two disconnecting ends which do not require unification after a series of circles are formed.

Such band and link structures minimize damage to the ring. The band's disconnecting ends design and the link's floating or movable feature can disrupt the impact force sustained from dropping and prevent the impact force from reaching the areas that are likely to cause detachment. The link also prevents the band's disconnecting ends from widening over time.

Such band and link structures provide additional reflection angles and viewing angles for the decorative element based on hand and finger movements, without requiring any setting adjustment or any other deliberate actions from the wearer. The configurations allow the wearer to show the extra angles unintentionally. The buyer can also choose a different material and/or shape for the link (round tubular link, square tubular link, etc.) to get a unique design. The ring also provides settings located at locations that are away from the central location of ring where the decorative element is usually installed. This arrangement gives the ring a distinctive appearance that does not exist in conventional rings.

Embodiments in accordance with principles of the present invention are described below. Other advantages are also described or understood from the disclosure below.

FIGS. 1-5 depict one embodiment of the article of jewelry. In this embodiment, the article of jewelry is a finger ring 100. The finger ring 100 comprises a band 105 and a tubular link 110. The band 105 includes a first end 115 and a second end 120 spaced by an opening 125. The length L1 of the opening 125 (between the first end 115 and second end 120) is shorter than the length L2 of the hand (excluding the length of the opening 125). The first end 115 and the second end 120 point toward each other. The first end 115 includes a first hole 130 and the second end 120 includes a second hole 135. The band 105 also includes and a top surface 140 and a bottom surface 145, and the bottom surface 145 is the surface that contacts a finger when the ring 100 is worn on a finger. Each of the holes 130, 135 is a through hole that extends from the bottom surface 145 to the top surface 140. The band 105 defines an internal area or finger fitting area A having a diameter or diameter range D (e.g., between 14 and 22 mm), or a circumference or circumference range C (e.g., between 46 mm and 68 mm, including the opening 124), that fits most fingers or finger sizes, whether the finger is a ring finger, middle finger, index finger, or other fingers. The band 105 may be a single piece structure that is rigid and can withstand bending, or pulling or opening from its two ends 115, 120, by hands. The finger fitting area A may be the only area though which the ring 100 can be worn (the band 105 itself cannot be opened or closed). The band 105 is also rigid enough to keep its two ends 115, 120 in place or in shape by the hand 105 itself, without requiring the tubular link 110 or other external force to bring or pull the two ends toward each other. The length L1 of the opening 125 is generally smaller than the width of a finger, and if the length L1 is larger than the finger width, the tubular link 110 can block the finger inserting from that location. The band 105 can be decorated with decorative elements and/or has different aesthetic designs 147 if necessary.

The tubular link 110 is connected to the first end 115 and the second end 120 to form the ring 100. The tubular link 100 includes a body 150 and a first jewelry setting 155 and a second jewelry setting 160. The body 150 may be a round, elliptical, rectangular, square, triangular, hexagonal, or other shape tube (refers to the cross section of the body 150). The body 150 includes a first end (or first prong) 165 and a second end (second prong) 170 that curve toward and/or go through the first hole 130 and the second hole 135, respectively. A portion of the body 150 is below the bottom surface 145 and the settings 155, 160 are above the top surface 140. The first end 165 and the second end 170 have a size that is smaller than the size of the holes 130, 135 so that the ends 165, 170 can be inserted though the holes 130, 135 and the body 150 can move within the holes 130, 135. There is a gap between the end 165, 170 and the hole 130, 135 and the gap has sufficient distance allowing the body 150 to move vertically with respect to the holes 115, 120 in response to hand or finger movements. In some embodiments, the distance may be large enough for further allow horizontal movements (e.g., the settings can tilt to the left or tight or the setting can be raise to different heights). The body 150 (e.g., the portion between the two prongs) extends (e.g., curves) toward the center of the band 105 (e.g., the center point from which the band radius or diameter is calculated), and can push against the finger in the band 105. The body 150 may extend deep enough into the band 105 so that the finger would always contact the body 150 when the ring 100 is worn. Therefore, the tubular link 110 may also be referred to the curved tubular link 100 or the arcuate tubular link 100 (the body 150 may also be referred to as the curved body 150 or the arcuate body 150). Upward movement or force by the finger can push the tubular link 110 upwards and against the band 105. This action also elevates the settings 155, 160 from the top surface 145 of the band 105. Release of that force or finger downward movement can cause the tubular link 110 to move downwards and the settings 155, 160 to re-contact the top surface 140 of the band 105.

For example, when the wearer moves her finger with the ring downward, the movement may cause the tubular link 150 to move downward or sink (so the settings 155, 160 contact the top surface 140 of the band 105). When the wearer moves her finger with the ring upward, the movement may cause the tubular link 150 to move upward or raise (so the settings 155, 160 are lifted above the top surface 140 of the band 105). For another example, when the wearer moves her hand to a first position, the tubular link 110 may tilt to the left. When the wearer moves her hand to a second position, the tubular link 110 may tilt to the right. These configurations and movements also cause the settings 155, 160 (and the decorative element) to move or tilt in the respective direction as they are connected to the body 150.

In other words, the finger ring 100 includes a tubular link 110 that is movable in response to hand or finger movements. The movements cause the settings 155, 160 and the decorative element thereon to move or tilt as well. The tubular link 110 hangs or floats on the band 105, and the tubular link 110 can move when the wearer walks, clenches her hand, opens her fist, extends her arm, makes hand gestures, or makes other movements and gestures. The tubular link 110 is loose with respect to the band 105. In some embodiments, the tubular link 110 can tilt or slide to a position where one of the settings is higher than the other one of the settings (the settings have an uneven height), in addition raising or lowering both settings simultaneously to the same height. The tubular link 110 can move vertically (up and down) and horizontally (left and right) with respect to the band 105. The tubular link 110 is not fixed to the band 105 (i.e., not attached to the band by adhesive, welding, fasteners, snap on, or other connection to prevent the tubular link 100 from moving with respect to the band 105).

The first end and second end 165, 170 of the body 150 are connected to the setting 155, 160, respectively. The settings 155, 160 extend above the top surface 140 and the opening 125 is between the settings 155, 160. Area above, below, and in the opening 125 are devoid of decorative element setting and/or decorative element. A portion the body 150 is below the opening 125. The holes 130, 135 are structured and dimensioned in a manner allowing the tubular link 110 to move with respect to the band 105 and allowing the settings 155, 160 to stay above the top surface 140. The holes 130, 135, in their entirety, are structured and dimensioned in a manner to limit movements of the settings 155, 160 to above the top surface 140. In other words, each of the holes 130, 135, in its entirety, blocks the respective setting from escaping the respective hole or moving to a location below the top surface 140 or the bottom surface 145 of the band 105. There is no room in each of the holes 130, 135 that allows the tubular link to be partially released (i.e., one of the prongs of the tubular link is released from the hole) or completely released (i.e., both prongs of the tubular link are released from the holes) from the band 105. The band 105 includes two opposite side surfaces, or front side surface 162 and back side surface 164, in addition to the top surface 140 and bottom surface 145. The prongs of the body 150 and their movements are kept between the side surfaces and cannot move or be released to an area outside the side surfaces. The holes 130, 135 may be the only holes on the band 105 to receive the body 150 of the tubular link 110. Each of the holes 130, 135 may completely enclose the respective prong therein in a radial direction, or in a direction perpendicular to the tubular link 150's vertical movement.

In one embodiment, the settings 155, 160 are larger than the size of the holes 130, 135 to prevent the tubular link 110 from disengaging the band 105 (e.g., slipping out from the holes 130, 135). The settings 155, 160 can contact the top surface 140 of the band 105 but the size of the settings 155, 160 prohibits the settings 155, 160 from escaping the holes 130, 135 or moving to a location below the top surface 140 or the bottom surface 145 of the band 105. The size of the settings 155, 160 (or the holes 130, 135) keep them above the top surface 140. The settings 155, 160 allow the tubular link 110 to hang or float on the band 105.

One of the settings 155, 160 serves as a stopper to the other one of the settings 155, 160 (and vice versa) to prevent the removal of the tubular link 110 from the band 105. For example, when a person attempts to remove the tubular link 110 by pulling one of the settings (e.g., 155) upwards or away from the band 105, the size of the other one of the settings (e.g., 160) prevents that setting (160) from exiting the second hole 135 or dropping toward the bottom surface of the band 105 (because the setting 160 is larger than the second hole 135). When the tubular link 100 is elevated with respect to the band 105 due to hand or finger movement, a portion of the body 150 (e.g., the bottom portion of the arcuate body) contacts the bottom surface 145 of the band 105 or the first end 115 and second end 120 of the band 105. The contact keeps the tubular link 110 and the band 105 together and prevents them from separating.

The tubular link 110 and the band 105 are inseparable by hand, or separating them by hand may require a force sufficient to break either of or both the tubular link 150 and the band 105. The tubular link 110 and the band 105 are pre-made components and pre-assembled using machines to form a finger ring. The tubular link 110 can be decorated with decorative elements and/or has different aesthetic designs if necessary.

A jewelry setting refers a base, usually a metal base, that is adapted to support and secure a decorative element. A jewelry setting is also known as a jewelry mounting. Each of the settings 155, 160 can be a bezel setting, prong setting, or other types of settings that are well-known in the art. The decorative element may be an element or structure crafted using precious metals or stones such as platinum, titanium, gold, silver, gem, diamond, sapphire, jade or the like. The band 105 may also be made of the same or similar materials. The setting 155 and the setting 160 can have sizes different from each other, and the decorative element on the respective setting can also have sizes and materials different from each other. Other materials can also be used to make the decorative element such as crystal, pearl, coral, glass, and plastic. Other types of decorative elements can also be used such as coin, timepiece, and other items.

Figure 5:
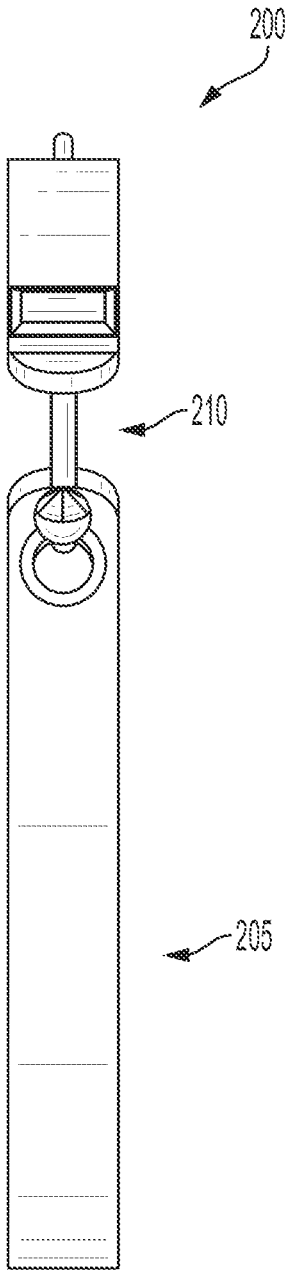
FIG. 5 depicts a side view or top view of another illustrative article of jewelry in accordance with some embodiments of the present invention.
Figure 6:
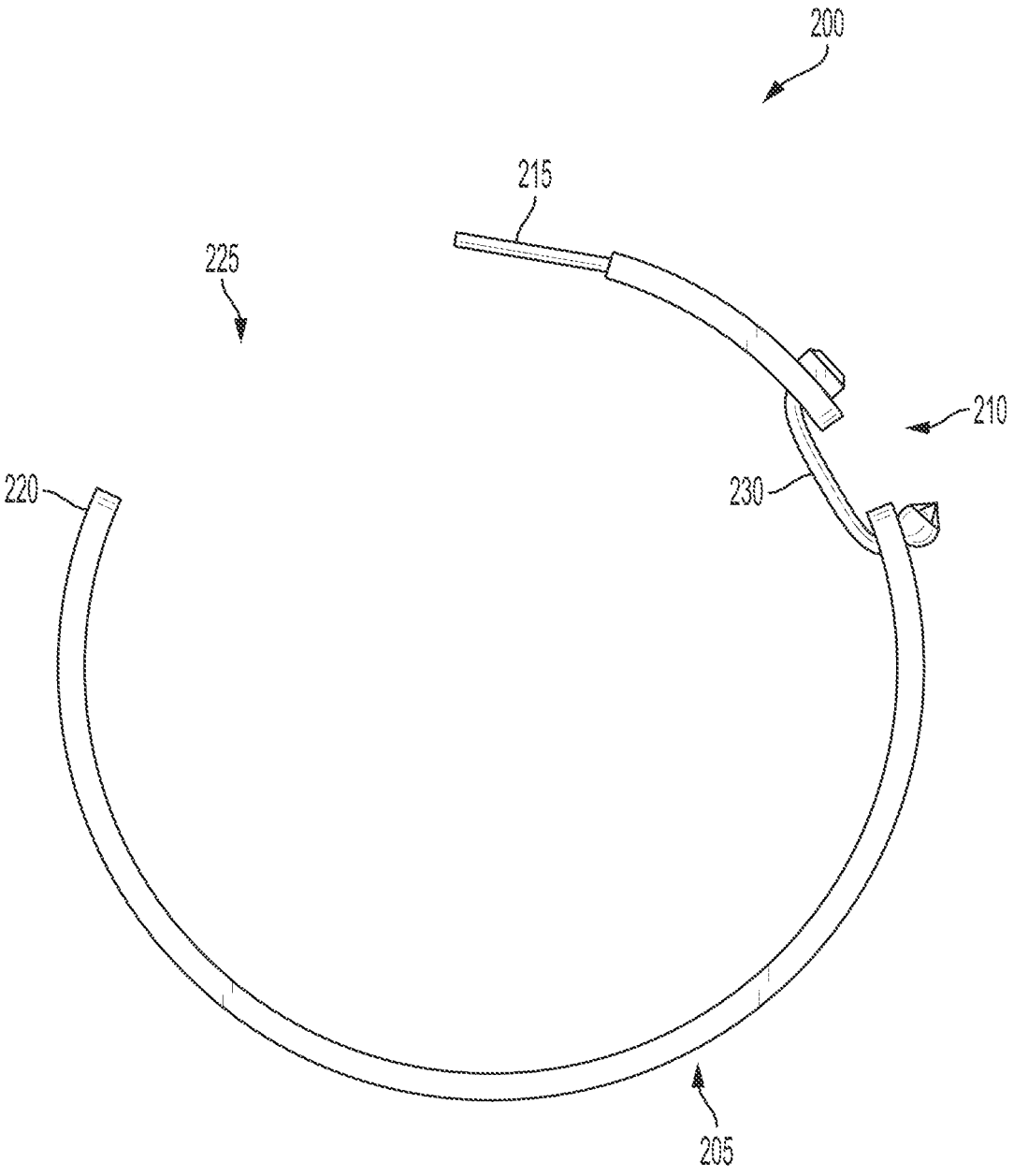
FIG. 6 depicts a front view of the illustrative article of jewelry of FIG. 5 in accordance with some embodiments of the present invention.

FIGS. 5-6 depict another embodiment of the article of jewelry. In this embodiment, the article jewelry is an ear ring 200 and it includes the same components and structures described above. Therefore, the descriptions of those components and structures also apply here and will not be repeated for the sake of brevity. The following section will focus only on the differences. The ear ring 200, or the band 205 and tubular link 210, can be modified or adjusted to have sizes and designs suitable for an ear ring.

The band (or frame) 205 of the ear ring 200 includes a pin 215 and a receptacle 220 adapted to receive the pin 215. The band 205 can be opened and closed via the pin 215 and receptacle 220. The pin 215 can be inserted into the receptacle 220 to close the band 205 and form a closed loop. The pin 215 and the receptacle 220 can be separated to open the band 205 and form an open loop or an opening 225 for receiving earlobe. Once the earlobe is in the band 205, the pin 215 is inserted through a hole in the earlobe and then into the receptacle 220. Once the pin 215 is in the receptacle 220, the pin 215 and the receptacle 220 can be locked and unlocked by mechanisms and methods that are well known in the ear ring industry to secure the ring 200 on the earlobe or release the ring 200 from the earlobe, respectively.

The body 230 of the tubular link 210 may not need to extend deep enough into the band 205 allowing the body 230 to contact earlobe when the ring 200 is worn. The tubular link 210 hangs or floats like the tubular link 110 and can move with respect the band 205 in response to head movement or other (e.g., movement). The tubular link 210 is loose with respect to the band 205. In some embodiments, the tubular link 210 can be fixed to the band 205 such that the tubular link 210 is immobile with respect the band 205. The tubular link 210 does not move with respect to the band 205 in response to head movement or other movement. A combination of hanging and fixing the tubular link 210 to the band 205 is also contemplated. For example, one end of the tubular link 210 can be fixed to the band 205 and another end of the tubular link 210 can be mobile or loose with respect to the band 205.

It is understood that the components, structures, and concepts described herein are applicable to other kinds of jewelry articles beyond finger ring and ear ring, such as bracelet, bangle, necklace, and other ring-shaped articles of jewelry. In the other kinds of jewelry articles, the tubular link or body is configured to curve toward the corresponding limb or body part, such as wrist, ankle, and leg.

The above are illustrative embodiments of the present invention. Variations, modifications, and generalizations are contemplated and understood to be part of the invention in view of the present disclosure. It should be understood that combinations of described features or steps are contemplated even if they are not directly described together or not in the same context. The words "may" and "can" are used in the present description to indicate that this is one embodiment and should not be understood to be the only embodiment. It is intended that the specification and examples be considered as exemplary only, with a true scope being indicated by the claims and their equivalents.

The invention claimed is:

1. A wearable finger ring comprising:

a band including a first end and a second end, an opening between the first end and the second end, and an outer circumferential surface an inner circumferential surface, wherein the first end comprising a first hole and the second end comprising a second hole; and a tubular link including a body and a first jewelry setting and a second jewelry setting, wherein the body comprises a first prong and a second prong inserted through the first hole and the second hole, respectively, the first jewelry setting is connected to the first prong inserted through the first hole and the second jewelry setting is connected to the second prong inserted through the second hole, and the first jewelry setting and the second jewelry setting are on the outer circumferential surface;

wherein the body further comprises a portion between the first prong and the second prong extending toward center of the band and the tubular link is movable with respect to the band.

2. The wearable finger ring of claim 1, wherein the opening is between the first jewelry setting and the second jewelry setting.

3. The wearable finger ring of claim 1, wherein the tubular link hangs on the band via the first jewelry setting and the second jewelry and is loose with respect to the band.

4. The wearable finger ring of claim 1, wherein the opening between the first end and the second end is devoid of a decorative element.

5. The wearable finger ring of claim 1, wherein the first hole and the second hole are the only holes on the band.

6. The wearable finger ring of claim 5, wherein the first hole, in its entirety, blocks the first jewelry setting from escaping the first hole to a location below the bottom surface of the band.

7. The wearable finger ring of claim 6, wherein the second hole, in its entirety, blocks the second jewelry setting from escaping the second hole to a location below the inner circumferential surface of the band.

8. The wearable finger ring of claim 1, wherein size of the first jewelry setting and the second jewelry setting is larger than size of the first hole and the second hole.

9. The wearable finger ring of claim 1, wherein the portion between the first prong and the second prong extending toward the center of the band with sufficient length to be contacted by a finger when the wearable finger ring is worn on the finger.

10. The wearable finger ring of claim 9, wherein the tubular link is movable with respect to the band based on a finger's movement or hand movement.

11. The wearable finger ring of claim 1, wherein the tubular link is movable between a position where the first jewelry setting and the second jewelry setting contact the band and a position where the first jewelry setting and the second jewelry setting are raised above the band.

12. The wearable finger ring of claim 1, wherein the band further includes a pin and a pin receptacle adapted to receive the pin.

13. The wearable finger ring of claim 12, wherein the pin and pin receptacle are adapted to open and close the band.

14. An article of jewelry comprising:

a band including a first end and a second end, an opening between the first end and the second end, and an outer circumferential surface and an inner circumferential surface, wherein the first end comprising a first hole and the second end comprising a second hole; and a tubular link including an arcuate body and a first jewelry setting and a second jewelry setting, wherein the arcuate body comprises a first prong and a second prong inserted through the first hole and the second hole, respectively, the first jewelry setting is connected to the first prong inserted through the first hole and the second jewelry setting is connected to the second prong inserted through the second hole, and the first jewelry setting and the second jewelry setting are on the outer circumferential surface;

wherein the arcuate body curves toward center of the band and has a sufficient length into the band to contact a finger when the article of jewelry is worn on the finger, and the tubular link is movable with respect to the band based on the finger's movement or hand movement;

wherein the opening between the first end and the second end is devoid of a decorative element.

* * * * *